United States Patent [19]

Johnson et al.

[11] 4,403,476

[45] Sep. 13, 1983

[54] METHOD FOR OPERATING A STEAM TURBINE WITH AN OVERLOAD VALVE

[75] Inventors: Lloyd H. Johnson, Scotia; Robert S. Couchman, Ballston Lake; Robert C. Spencer, Jr., Burnt Hills; John A. Booth, Scotia; Russell J. Holman, Schenectady, all of N.Y.

[73] Assignee: General Electric Company, Schenectady, N.Y.

[21] Appl. No.: 317,697

[22] Filed: Nov. 2, 1981

[51] Int. Cl.[3] ..... F01K 13/02

[52] U.S. Cl. ..... 60/652; 60/662; 60/677

[58] Field of Search ..... 60/652, 660, 662, 677

[56] References Cited

U.S. PATENT DOCUMENTS

| | | | |
|---|---|---|---|
| 1,798,894 | 3/1931 | Noack et al. | 60/677 X |
| 2,254,424 | 9/1941 | Gleichmann | 60/652 X |
| 4,118,935 | 10/1978 | Andersson | 60/677 X |

OTHER PUBLICATIONS

J. E. Downs et al., "Large Steam Turbine-Generators with Spinning Reverse Capacity", vol. XXII—Preceedings of the American Power Conference, 1960.

*Primary Examiner*—Allen M. Ostrager

*Assistant Examiner*—Stephen F. Husar

*Attorney, Agent, or Firm*—Robert C. Kain, Jr.; John F. Ahern

[57] ABSTRACT

A method is disclosed for operating a steam turbine using turbine reserve capacity for attaining operation at elevated loads. In a preferred form of the invention, a bypass overload valve is provided in parallel with the steam admission control valves but is connected to discharge steam to a lower pressure stage of the turbine. During operation of the turbine at less than full load, the bypass overload valve is maintained closed and the control valves are positioned to sustain a preselected load. As load on the turbine increases, the control valves are increasingly opened until they have all reached their fully opened position corresponding to a nominal rated capacity of the turbine. Then, at the discretion of operating personnel, the bypass overload valve is fully opened while simultaneously one or more of the control valves is throttled to offset any steam passing through the bypass overload valve in excess of the amount required to sustain the preselected turbine load. A throttling reserve is thus established on the control valves which may then be positioned toward their fully opened position to achieve greater power output.

11 Claims, 2 Drawing Figures

METHOD FOR OPERATING A STEAM TURBINE WITH AN OVERLOAD VALVE

BACKGROUND OF THE INVENTION

This invention pertains to a method of operating a steam turbine using turbine reserve capacity for operation at elevated loads.

Large steam turbines of the type used in the electrical power generating industry are liberally designed to provide some additional load capability beyond the nominal rated capacity, an operating point commonly referred to as the "guarantee point." The nominal rated capacity is stated in terms of power output, and conventionally, this condition is achieved with the control valves less than fully open so that the additional capability is obtained by opening the control valves fully. If the turbine design is such that the nominal rated capacity occurs with the steam admission valves fully open, the turbine efficiency at that point will be improved significantly in terms of energy utilization or heat rate. However, with the control valves fully open, there are limited means by which reserve capacity of a steam turbine can be achieved.

One known method of achieving excess capacity in a turbine when the nominal rated capacity occurs with the control valves fully open, is to provide a bypass valve and thereby pass extra steam around the control valves to a latter lower pressure stage of the turbine. This method (as used in the past) has three disadvantages. First, it has been considered necessary to integrate the bypass valve into the turbine control system, in effect making the bypass valve an additional control valve which is throttled in a controlled and coordinated manner with the admission control valves. This adds significantly to the complexity of the control system. Second, to meet industry incremental regulation requirements with a throttling type bypass valve, it has been necessary to provide some overlap between the control valves and the bypass valve. In other words, it becomes necessary to begin opening the bypass valve before the control valves are fully open. This degrades the efficiency of the turbine at its nominal rated capacity. Third, because of the small capacity of such a bypass valve, considerable valve stroking motion is required to have the turbine participate in frequency control in the power system to which it is connected. This large motion may cause heavy wear and lead to early failure of the valve.

Accordingly, it is an object of the present invention to provide a method for operating a steam turbine by which a bypass overload valve is used to achieve reserve capacity of the turbine with no substantial change to the turbine control system and in which a throttling type bypass valve is not required to be used.

Further, it is an object of the invention to maximize steam turbine efficiency at the nominal rating point by the use of a bypass overload valve while eliminating the need to provide overlap in operation between the control valves and the bypass overload valve.

SUMMARY OF THE INVENTION

In a preferred method of operating a steam turbine according to the invention, a bypass overload valve is provided in parallel with the control valves and is connected to discharge steam to a lower pressure stage of the turbine. During operation of the turbine at less than full load, the bypass overload valve is maintained in a closed position and the control valves are positioned to sustain a preselected power load. As the load demand on the turbine increases, the control valves are increasingly opened in support of the load until all control valves have reached their maximum operating position (valves wide open) corresponding to the nominal rated capacity. Then, at the operator's option, the bypass overload valve is fully opened, while substantially simultaneously, one (or more) of the control valves is throttled back to offset any steam passing through the bypass overload valve in excess of that amount required to sustain the preselected turbine load. A throttling reserve is thus established on the control valves which may then be positioned toward their fully opened position to achieve additional power output capability. The bypass overload valve is operated simply in an open-closed manner and throttling control is at all times carried out by the main control valves. The bypass overload valve preferably is capable of carrying steam flow in the range of five percent of the total steam flow.

BRIEF DESCRIPTION OF THE DRAWINGS

While the specification concludes with claims particularly pointing out and distinctly claiming the subject matter regarded as the invention, the invention will be better understood from the following description taken in connection with the accompanying drawings in which:

DETAILED DESCRIPTION OF THE INVENTION

Figure 1:
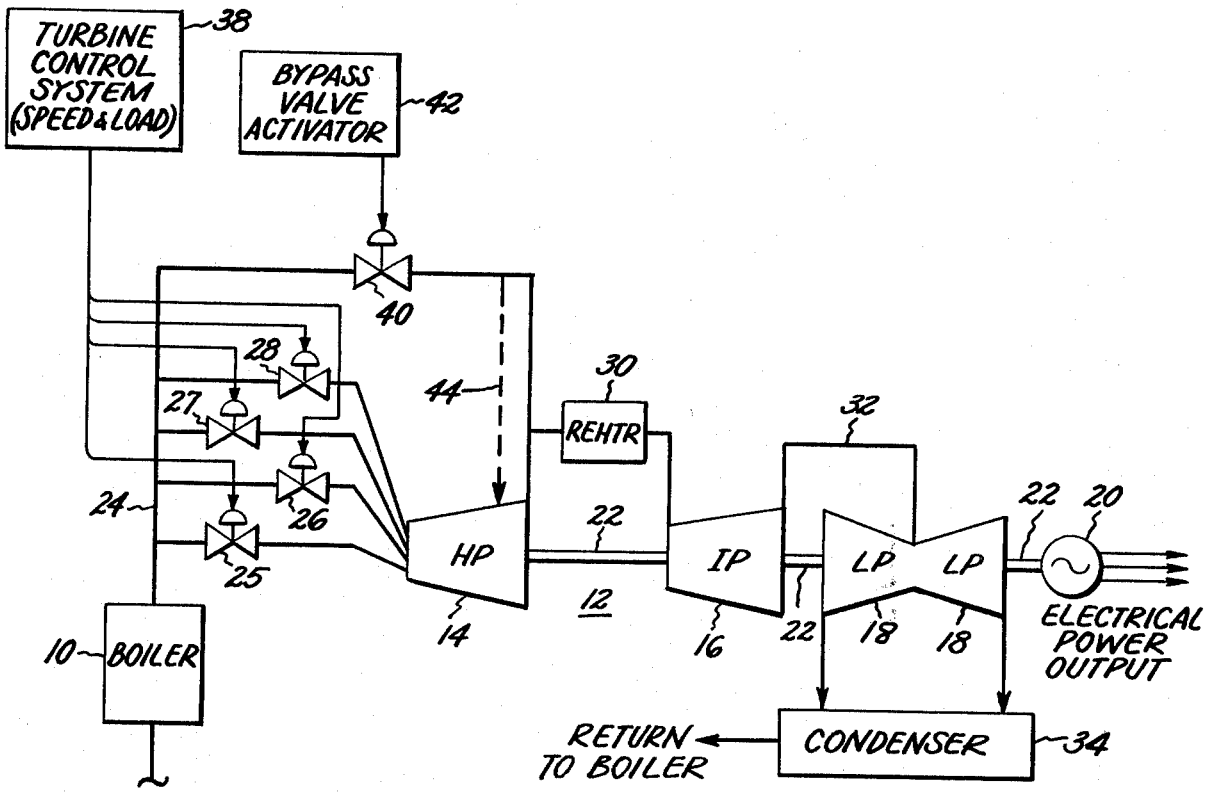
FIG. 1 is a simplified schematic illustration of a turbine-generator power plant in which the turbine utilizes a bypass overload valve according to the invention.

In the electrical power generating plant of FIG. 1, a boiler 10 serves as the source of high pressure steam, providing the motive fluid to drive a reheat steam turbine 12 which includes high pressure (HP) section 14, intermediate pressure (IP) section 16, and a low pressure (LP) section 18. Although the turbine sections 14, 16, and 18 are illustrated to be tandemly coupled to each other and to generator 20 by shaft 22, other coupling arrangements may be used.

The steam flow path from boiler 10 is through steam conduit 24 from which steam may be taken to HP turbine 14 through admission control valves 25–28. Each control valve, of 25–28, is connected to discharge steam to the HP section 14 either through circumferentially arranged nozzle arcs in a partial admission configuration or to a single space ahead of the first stage nozzles in a single admission configuration. Both of these configurations are well known in the art. Further, the control valves of a turbine with the partial admission arrangement may be operated either simultaneously, in the full arc mode, in which case steam is admitted to the HP section 14 in an essentially uniform circumferential pattern so that the turbine operates like a single admission turbine, or they may be operated sequentially, in the partial arc mode, in which case steam is admitted first to one or more nozzle arcs and then to the others in sequence as the turbine load is increased.

Steam exhausted from the HP section 14 passes through reheater 30 wherein the temperature of the steam is increased. Subsequently, steam from the reheater is passed to IP section 16 then, through crossover conduit 32, to LP section 18. Steam exhausted from the LP section 18 flows to the condenser 34 from which there is a recycle of condensate back to the boiler 10.

Although control of a steam turbine is a very complex and complicated process, with the turbine operating at essentially steady state the principal considerations are to maintain the turbine's speed and load. With reference to FIG. 1, these variables are controlled by feedback control system 38 which positions (i.e., determines the degree of opening of) control valves 25–28 to admit more or less steam to the turbine 12. Such control systems are well known and control system 38, for example, may be of the type disclosed by U.S. Pat. No. 3,097,488, the disclosure of which is incorporated herein by reference.

As the turbine load demand is increased, the control system 38 positions one or more of the control valves 25–28 to admit more steam to the turbine to increase the electrical power supplied by the generator 20. Ultimately, as the load continues to increase, all of the control valves 25–28 are fully opened and the turbine 12 has reached its nominal rated capacity. It will be recognized that the most efficient operating point (i.e., lowest heat rate) of the turbine in terms of minimizing throttling losses is also attained with the control valves wide open.

Virtually every turbine is designed to provide reserve capacity for producing power over the nominal rated capacity. For gaining additional power from the turbine after the control valves have reached their limit, there is provided, according to a preferred embodiment of the invention as shown in FIG. 1, a bypass overload valve 40 connected between the steam supply conduit 24 and the reheat point ahead of reheater 30. For control of the bypass overload valve 40, a simple open-closed (manual or automatic) control 42 is provided that actuates valve 40 to be opened whenever the load demand is greater than the nominal rated capacity. For manual operation of the overload valve 40, a simple switching arrangement may be used and the valve 40 opened at the discretion of operating personnel whenever the control valves 25–28 are fully open. For automatic operation, a load indicative signal (derived from control system 38, for example) can be used to trigger the overload valve 40 open at the appropriate point. In either case, because of the effect on turbine load, actuation of overload valve 40 produces a response, through the control system 38, on the control valves 25–28.

For example, with the control valves 25–28 fully open and the turbine 12 operating at its nominal rated capacity, additional power is attained by fully opening the overload bypass valve 40. This allows a quantity of steam to bypass the higher pressure sections of the turbine and enter the low temperature side of the reheater 30. Alternatively, however, the bypassed steam through overload valve 40 may be admitted to a lower pressure stage of the high pressure section 14 as indicated by the dashed line 44. In either case, there is an increase in total steam flow into the turbine, which, if maintained, enables the turbine 12 to produce a greater output. Operationally, the control system 38 is responsive to changes in either turbine speed or load so that, with a fixed load, the control system 38 will cause one or more of the control valves 25–28 to be repositioned to a more closed position substantially simultaneously with the opening of the bypass overload valve 40 to compensate for any excess steam passing through valve 40. Thus, once the bypass overload valve 40 is open, the control valves are again in throttling control and a margin is established for increasing the turbine's power output.

Control valves 25–28 pass the bulk of the steam flow and are therefore larger in size than overload valve 40. Thus by avoiding continuous throttling with overload valve 40, and by making it simply either fully opened or closed, there is less valve stem motion for a given steam flow change and less total valve wear.

Figure 2:
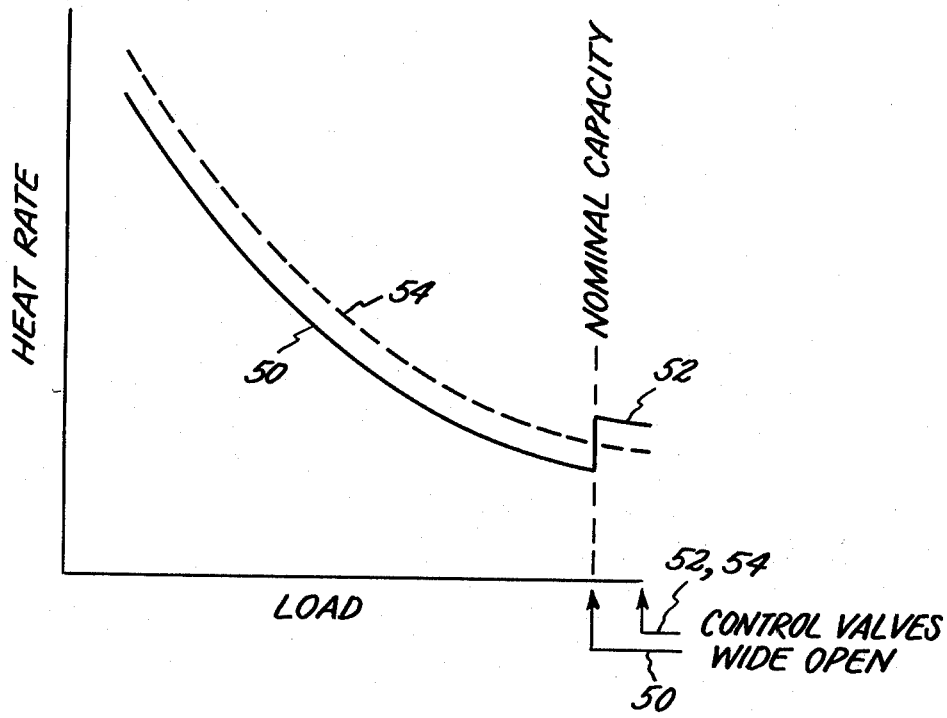
FIG. 2 illustrates the relationship between heat rate and power output for a steam turbine operated according to the present invention and illustrates a similar relationship for a steam turbine operated in a conventional manner without a bypass overload valve.

Referring now to FIG. 2, curve 50 illustrates the approximate relationship between turbine load and heat rate for operation of a turbine according to the invention. Curve 50 defines the efficiency in terms of heat rate at a given load for a turbine having a bypass overload valve which comes into play as described herein, when more power output is desired than that produced with all control valves fully open. FIG. 2 illustrates the relationship for a single admission configuration for clarity; however, the principle applies equally well to partial arc admission. As is well known, the heat rate is initially relatively high and improves substantially as turbine output is increased. Finally, with all control valves wide open the turbine is being operated at its most efficient point. Opening the bypass overload valve at this point, however, allows the power output to be increased (curve 50 is extended to the right along segment 52) but at a slight sacrifice in efficiency as indicated by a higher heat rate. In physical terms, the heat rate penalty results from the large reduction in steam pressure necessary in taking high pressure steam from the boiler and introducing it at a considerably lower pressure point in the turbine cycle.

For comparison purposes, and to fully illustrate the advantages of the invention, curve 54 illustrates the heat rate relationship for a conventional turbine valving arrangement wherein the nominal rated capacity occurs at a point below which the control valves are fully open. Notable is the fact that, when operated at its nominal rated capacity or less, the turbine of curve 50 provides significantly better performance in terms of heat rate while also being able to attain the same power output as the turbine of curve 54 with its control valves wide open.

Thus while there has been shown and described what is considered a preferred form of the invention, it is understood that various other modifications may be made therein. It is intended to claim all such modifications which fall within the true spirit and scope of the present invention.

The invention claimed is:

1. A method of operating a steam turbine delivering power to a connected load and adapted to receive steam from a steam generating source, the turbine having a plurality of control valves for controlling the admission of steam to higher pressure stages of the turbine and having a bypass overload valve connected to receive steam from the steam source and to discharge such steam to a power pressure stage of the turbine, said method comprising the steps of:

(a) maintaining said bypass overload valve closed while controllably positioning said control valves to admit steam to the turbine to sustain a preselected power load;

(b) increasingly opening said control valves with increasing load demand on the turbine until all valves of said plurality of control valves have reached a fully opened position;

(c) fully opening said bypass overload valve while substantially simultaneously controllably positioning at least one of said control valves toward a closed position sufficient to offset steam flow through said bypass overload valve in excess of that required to sustain the turbine load; and (d) further increasing the power output of the turbine by controllably positioning said plurality of control valves toward said fully opened position.

2. The method of claim 1 wherein said bypass overload valve is manually caused to be opened and closed at an operator's discretion and said control valves are at all times automatically positioned by an automatic control system.

3. The method of claim 2 wherein said plurality of control valves are positioned substantially simultaneously.

4. The method of claim 2 wherein said plurality of control valves are positioned substantially in sequence.

5. The method of claim 1 wherein said bypass overload valve is automatically caused to be opened and closed in response to a signal indicative of turbine load and said control valves are at all times automatically positioned by an automatic control system.

6. The method of claim 5 wherein said plurality of control valves are positioned substantially simultaneously.

7. The method of claim 5 wherein said plurality of control valves are positioned substantially in sequence.

8. In combination with a steam turbine delivering power to a connected load and adapted to receive steam from a steam generating source, the turbine having a plurality of control valves for controlling the admission of steam to higher pressure stages of the turbine, apparatus for operating the turbine at elevated power loads comprising: (a) a bypass overload valve connected to receive steam from the steam source and to discharge such steam to a lower pressure stage of the turbine, said valve being operable only between a fully opened position and a fully closed position; and (b) means for operating said bypass overload valve between said open and closed positions, said means effective to maintain said bypass overload valve in a closed position while said control valves are controllably positioned to admit steam to the turbine to sustain a preselected power load, and said means effective to open said bypass overload valve when at least one of said control valves is substantially simultaneously controllably positioned toward a closed position sufficient to offset steam flow through said bypass overload valve in excess of that required to sustain the turbine load.

9. The combination of claim 8 wherein said means for operating said bypass overload valve is a manual means operable at the discretion of operating personnel.

10. The combination of claim 8 wherein said means for operating said bypass overload valve is an automatic means operative in response to a signal indicative of turbine load.

11. The combination of claim 8 wherein said bypass overload valve has a steam flow capacity of less than five percent of the flow capacity of said plurality of control valves.

* * * * *